US005735022A

United States Patent [19]

Niedecker

[11] Patent Number: 5,735,022

[45] Date of Patent: Apr. 7, 1998

[54] PLASTIC CLIP IN TWO PARTS AND DEVICE FOR CLOSING THE SAME

[76] Inventor: Herbert Niedecker, deceased, late of Königstein 2, Germany, by Marie Luise Niedecker, legal representative, Am Ellerhang 6, D-61462 Königstein 2, DEX

[21] Appl. No.: 557,137

[22] PCT Filed: Jul. 19, 1994

[86] PCT No.: PCT/EP94/02367

§ 371 Date: Feb. 5, 1996

§ 102(e) Date: Feb. 5, 1996

[87] PCT Pub. No.: WO95/05320

PCT Pub. Date: Feb. 23, 1995

[30] Foreign Application Priority Data

Aug. 12, 1993 [DE] Germany ..... 43 27 064.6
Jan. 17, 1994 [DE] Germany ..... 44 01 111.3

[51] Int. Cl.[6] ..... B65D 77/00

[52] U.S. Cl. ..... 24/30.5 R; 24/543

[58] Field of Search ..... 24/30.5 R, 30.5 P, 24/543; 383/42

[56] References Cited

U.S. PATENT DOCUMENTS

| | | | |
|---|---|---|---|
| 3,247,852 | 4/1966 | Schneider | 24/543 |
| 4,275,485 | 6/1981 | Hutchison | 24/30.5 R |
| 4,386,752 | 6/1983 | Pavlak et al. | 24/543 |
| 4,416,038 | 11/1983 | Morrone, III | 24/543 |
| 4,775,121 | 10/1988 | Carty | 24/543 |
| 4,847,956 | 7/1989 | Levine | 24/30.5 R |
| 5,008,980 | 4/1991 | Zimmermann | 24/30.5 R |
| 5,125,133 | 6/1992 | Morrison | 24/30.5 R |
| 5,263,671 | 11/1993 | Baum | 24/543 |

FOREIGN PATENT DOCUMENTS

| | | | |
|---|---|---|---|
| 0356850 | 3/1990 | European Pat. Off. . | |
| 3441302 | 4/1986 | Germany | 24/543 |
| 9202983 | 11/1992 | Germany . | |
| 2241986 | 9/1991 | United Kingdom . | |

*Primary Examiner*—Victor N. Sakran
*Attorney, Agent, or Firm*—Sprung Kramer Schaefer & Briscoe

[57] ABSTRACT

In a two-part plastic clip for closing sausage casings, bags or the like the first part (1) comprises a U-shaped receiving space, which is defined by side cheeks and cross-flanges and receives the end of the sheath, which end has been gathered to form a tip. The second part (2) bridges the receiving space (4) of the first part (1) and is fixed to and interlocks with the first part. One transverse end of the second part (2) is hinged to the first part (1) by a film hinge (3) and at its other transverse end the second part (2) comprises a detent arm (16), which is engageable with a detent projection (22) provided at the other cross-flange (6) of the first part to close the clip. The side cheeks (5) are connected by a cross-bar (8), which is spaced from that cross-flange (6) which is close to the hinge and in the closed clip is embraced by an arm provided on the second part so that a high closing pressure will be exerted whereas the required elasticity will be maintained.

An apparatus for closing such a plastic clip consists of two troughs (37, 39) for receiving the two clip parts (33, 34). One receiving trough (37) is stationary and the other (39) is pivoted on an axis (40), which is aligned with the hinge axis (35) of the clip parts (33, 34). The pivotal movement to the position corresponding to the closed position of the clip is imparted to the second receiving trough (39) by mechanical drive means (38, 41, 42).

An improvement of the closing mechanism is constituted by positioning means (50, 53), which by means of a cam-controlled coupling member (56) advance out of a feed passage (32) into the receiving troughs (37, 39) of the closing mechanism each clip which is to be closed.

9 Claims, 11 Drawing Sheets

PLASTIC CLIP IN TWO PARTS AND DEVICE FOR CLOSING THE SAME

Figure 1:
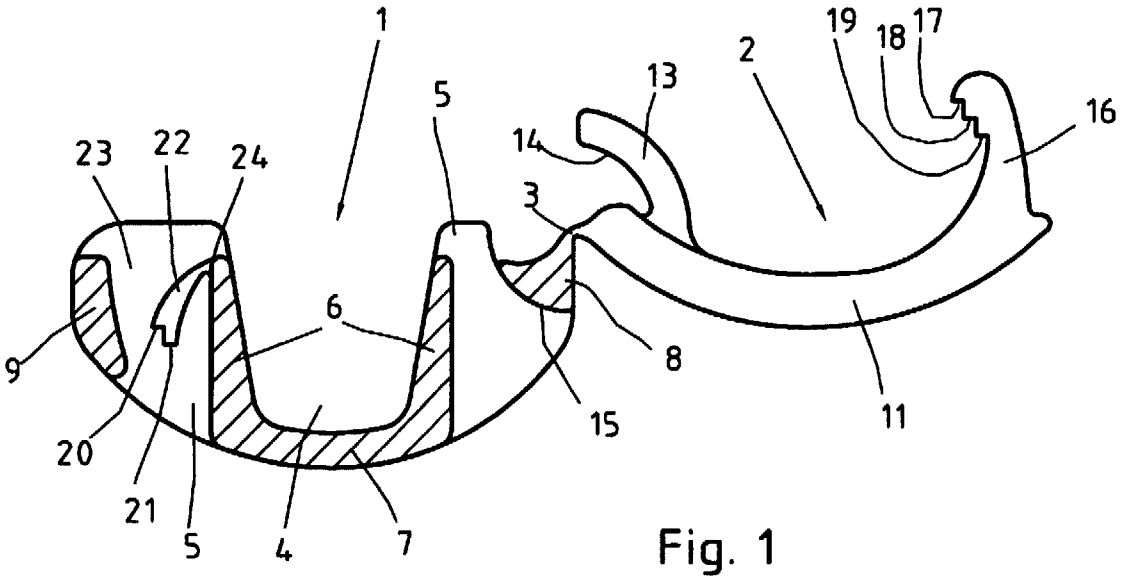

This invention relates to a plastic clip which serves to close sausage casings, bags or the like and consists of two parts, which embrace the casing end when it has been gathered to form a tip and which can be interlocked in that a first part having a receiving space that is defined by side cheeks and cross-flanges partly embraces the tip and a second part bridges the cross-flanges of the first part and at its one transverse end is hinged by a film hinge to the corresponding transverse end of the first part and has an extension which in the closed clip extends under a portion of the first part and adjacent to its other transverse end has a detent element, which cooperates with a complementary detent element of the first part. The invention relates also to an apparatus for closing such a clip or a plurality of such clips, which are connected in a chain.

U.S. Pat. No. 4,273,486 discloses a plastic clip which is of that kind and in its closed state has the shape of a substantially hollow cylinder and is split along a plane which is parallel to the axis of the clip. A rib of the second or cover part protrudes toward the receiving space in the larger first part but only spikes provided on said rib reach the passage for the tip material, which passage is defined at its top by the end wall. During the closing of the clip an extension which is provided on the rib of the second part and extends toward the film hinge is pivotally moved into a recess, which is formed in the cylindrical outer wall, which like cross-flange defines the cylindrical receiving space between the side cheeks, so that the parts are interlocked as by a hinge. On the opposite side, a detent hook formed on the second part extends into a locking opening the cylindrical outer wall, which constitutes there an oppositely disposed cross-flange.

Because in contrast to the plastic clip disclosed in EP-A-356 850 the two parts are additionally interlocked adjacent to the film hinge, it is possible mainly to exert a stronger closing force on the tip of the sausage casing or the like. But it is unsatisfactory that the interlock is very rigid and, e.g., does not permit an elastic yielding of the clip, e.g., when pressure peaks occur at the clip, e.g., as a result of a heat treatment of the contents of the package and such pressure peaks must be dissipated by ventilation. Similar remarks are applicable to the adaptation to different tip thicknesses.

The problems outlined hereinbefore are avoided by the invention in that the side cheeks of the first part are connected by a cross-bar, which is spaced from the cross-flange that is close to the hinge, and the second part is provided with an arm, which is spaced a corresponding distance from the film hinge and in the closed clip extends between the cross-flange and the cross-bar and under the crossbar. In cooperation with the cross-bar the arm ensures a reliable guidance of the two parts or the clip during the closing operation and by the positive joint in the closed clip ensures the transmission of a strong closing force adjacent to the hinge. Above all, because the positive joint is spaced from the receiving space the closed clip has in spite of its ability to transmit a strong closing force an adequate elasticity in case of different and/or changing stresses.

The new plastic clip is preferably so designed that the first part comprises side cheeks, which extend transversely to the longitudinal direction of the tip and have centrally disposed, aligend U-shaped recesses, and the second, which substantially covers the receiving space, is integrally formed with a projection that consists of a rib, which is parallel to the side cheeks and protrudes into the receiving space, so that the tip will be deflected in the shape of a wave and will be under a closing pressure when the clip is closed and interlocked.

A clip having such a design is basically known from WO 93/10012. One embodiment consists of two identical parts, which are turned through 180° relative to each other and are interlocked. Another embodiment consists of two different parts and comprises an open frame rather than a receiving space that is closed at the bottom. Both embodiments of that known plastic clip accomplish the object to automatically adapt themselves to different volumes of the tip of the sheath and to be able to elastically yield in case of need in order to dissipate an overpressure which may occur in the interior of the casing, e.g., during the production of sausages, whereas a subsequent loss of tightness will be aovided. But without a joint between the two parts the clip cannot satisfactorily be processed in high-speed closing machines.

A reliable interlock, which does not depend on the closing force exerted on the tip, will be achieved if in another desirable embodiment of the invention the side cheeks are extended in length also on the detent side and are interconnected by a second cross-bar and the detent arm is caused to extend between the second cross-bar and the other cross-web, which is adjacent to said other cross-bar, and the detent projection provided on the other cross-flange consists of a tongue, which extends from the free edge of the cross-flange and rearwardly outside the trough and is resillently prestressed away from the cross-flange.

The processing of the new clip by a machine can generally be facilitated in that the second part is integrally formed with severable webs, by which the free end of the second part is connected to the free end of the first part of a similar clip in a chain, which can be stored in a magazine. Said webs can easily be severed during the closing operation, as is known from the processing of conventional metal clips.

In its most general form the apparatus provided by the invention for closing plastic clips of the kind described hereinbefore comprises:

a) a stationary first holder for one clip part, b) a second holder for the other clip part, which second holder is pivoted on the hinge axis of the clip parts: and c) drive means for pivotally moving the second holder from a position corresponding to an open position of the clip to a position corresponding to a closed position of the clip.

The holder typically consist of receiving troughs, which are shaded to match the exterior shape of the two clip parts so that the closing force will be uniformly applied to the clip and the two clip parts will be interlocked in a position in which they firmly enclose the tip. The first holder for one clip part is stationary and positions that clip part so that the tip can be inserted into that clip part through a suitably arranged and shaped feeding slot. (As soon as this has thus been accomplished) the other clip part is pivotally moved by the movable second holder about the hinge between the two clip parts and the interlock is effected.

The drive means for moving the second holder desirably comprise a gear, which by means of a meshing driving member (rack, pinion or the like) can be turned through a certain angle from a position corresponding to the open position of the clip to a position corresponding to the closed position of the clip. The prime mover may consist, e.g., of a pneumatic cylinder, by which the driving element is reciprocated.

A passage for feeding a sequence of clips is preferably provided, which passage extends at right angles to the pivotal axis (of the holder, i.e., the hinge axis of the clip parts), and an abutment is preferably provided, which during the pivotal movement of the second holder promotes the severing of the clip to be closed from a chain of clips. In that case a clip which is being processed is virtually automatically severed during the closing operation from the chain which is being advanced through the feed passage.

In another embodiment of the invention, positioning means are provided, by which each clip that is to be closed is advanced into the holders. Those positioning means particularly comprise a coupling member, which during each feeding cycle is moved into one part of the clip that is presented in the feed passage and moves that part into the first holder and subsequently moves back out of the clip and along an arcuate path to its initial position. As a result, during the feeding portion of its movement the coupling member is virtually tangentially moved out of the mouth of the feed passage, to effect an interlock between the coupling member and the one clip part until the latter has been positioned in its holder. The coupling member is then moved out at right angles to the longitudinal direction of that clip part to open a space for receiving the bag tip to be inserted whereas the clip is not contacted by the coupling member as it returns to its initial position.

The feed cycle of the coupling member is preferably cam-controlled, desirably in such a manner that the coupling member is mounted on the piston of a pivoted fluid-operable cylinder and a cam-follower pin is also mounted on the piston and extends into t cam slot for controlling the movement of the coupling member.

Illustrative embodiments of the invention are shown on the drawing, in which

Figure 2:
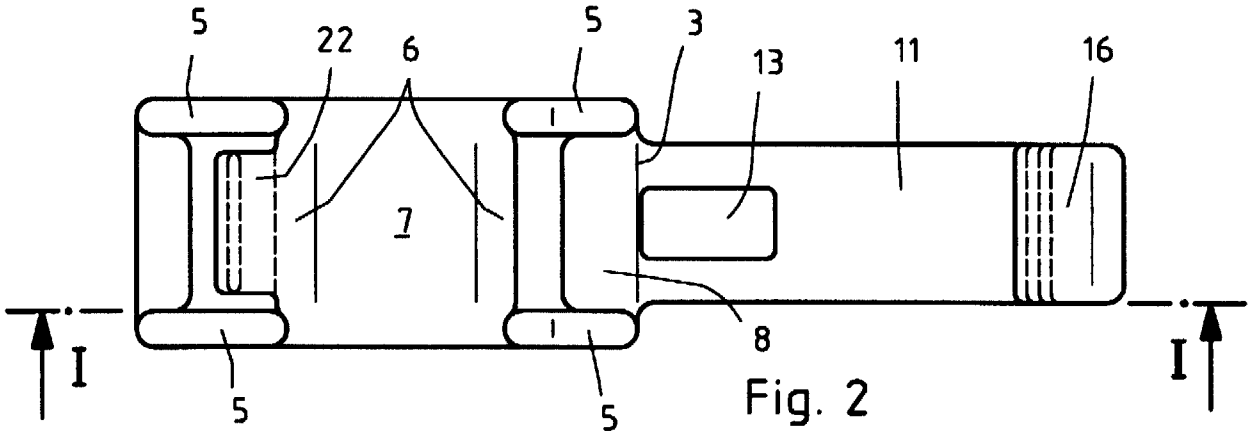
Figure 3:
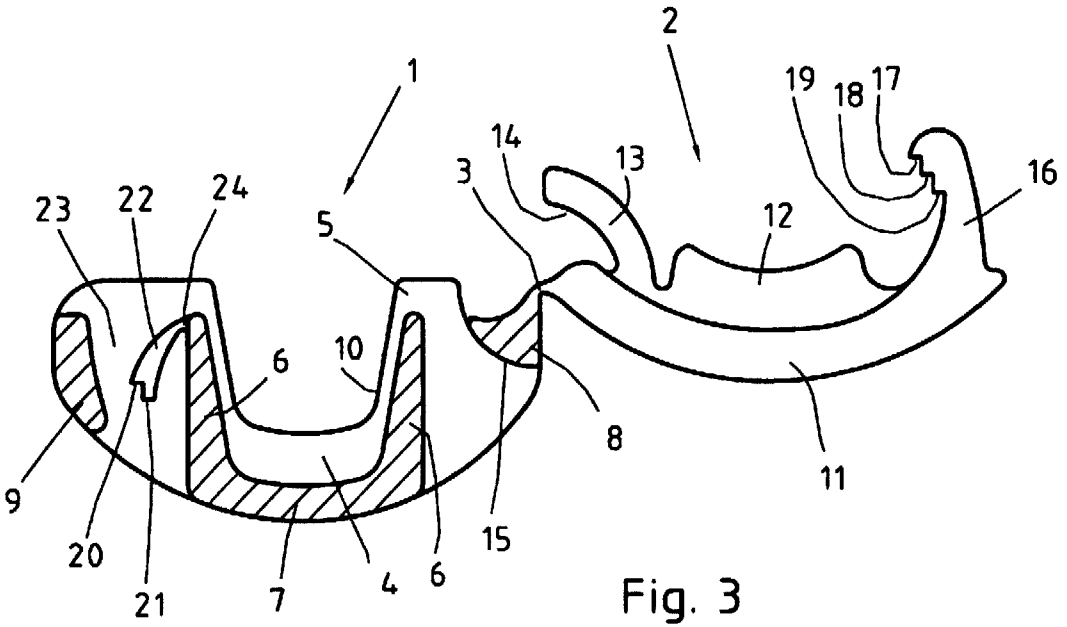
Figure 4:
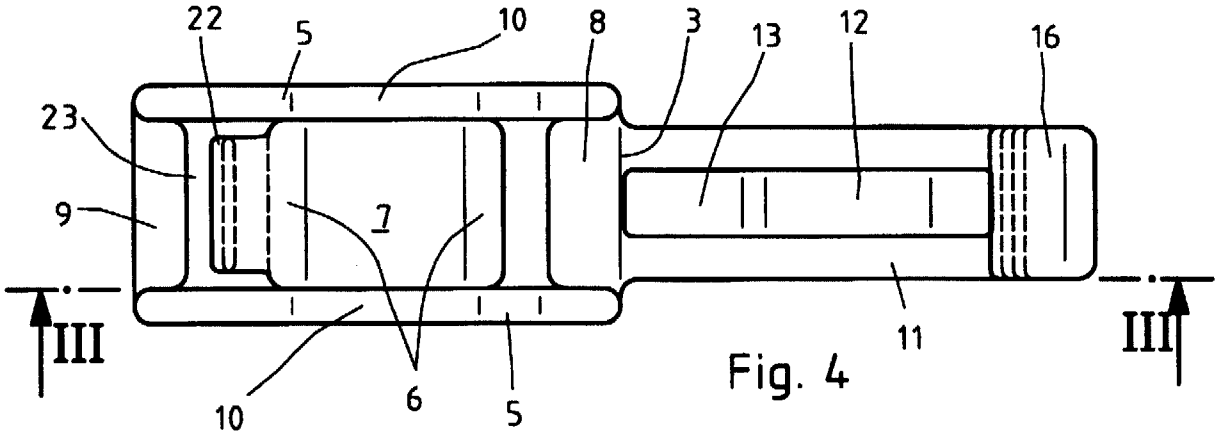
Figure 6:
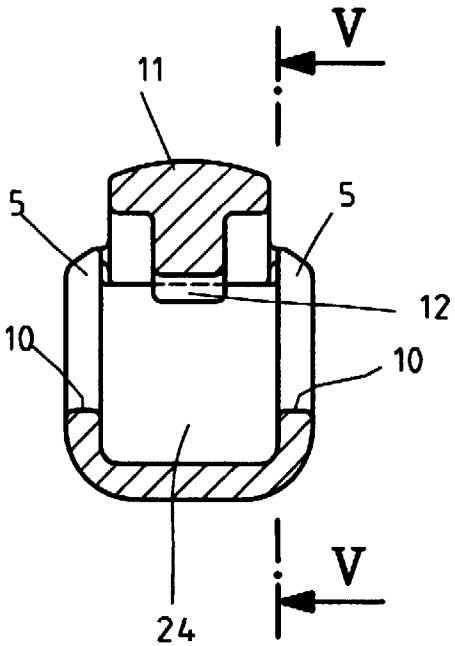
Figure 5:
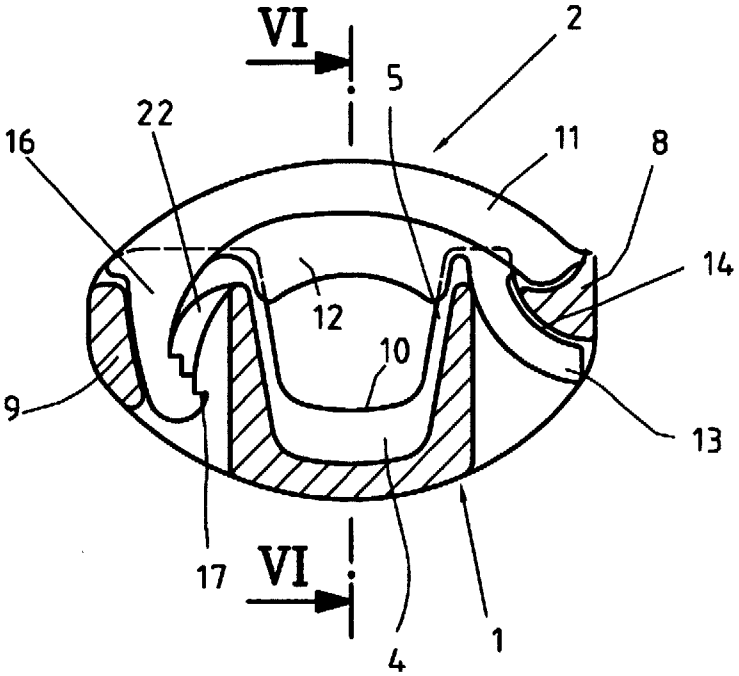
Figure 7:
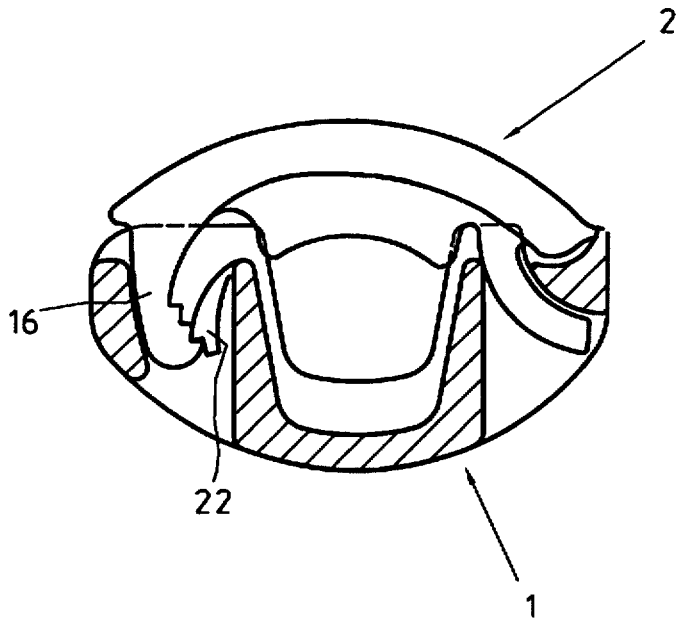
Figure 8:
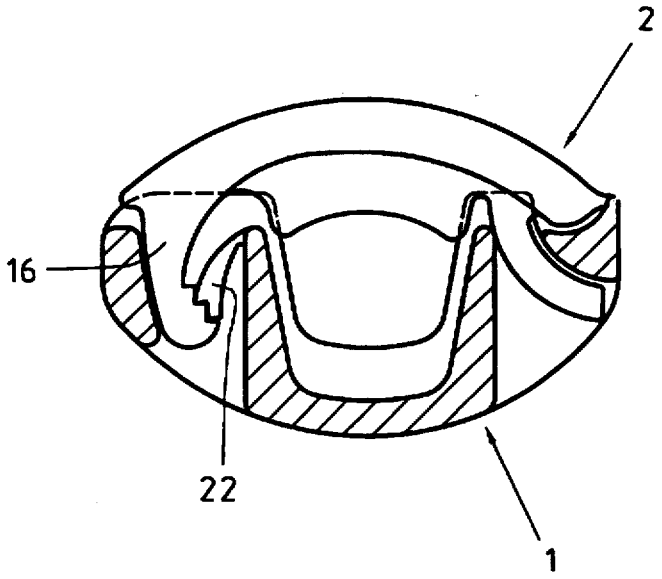
Figure 9:
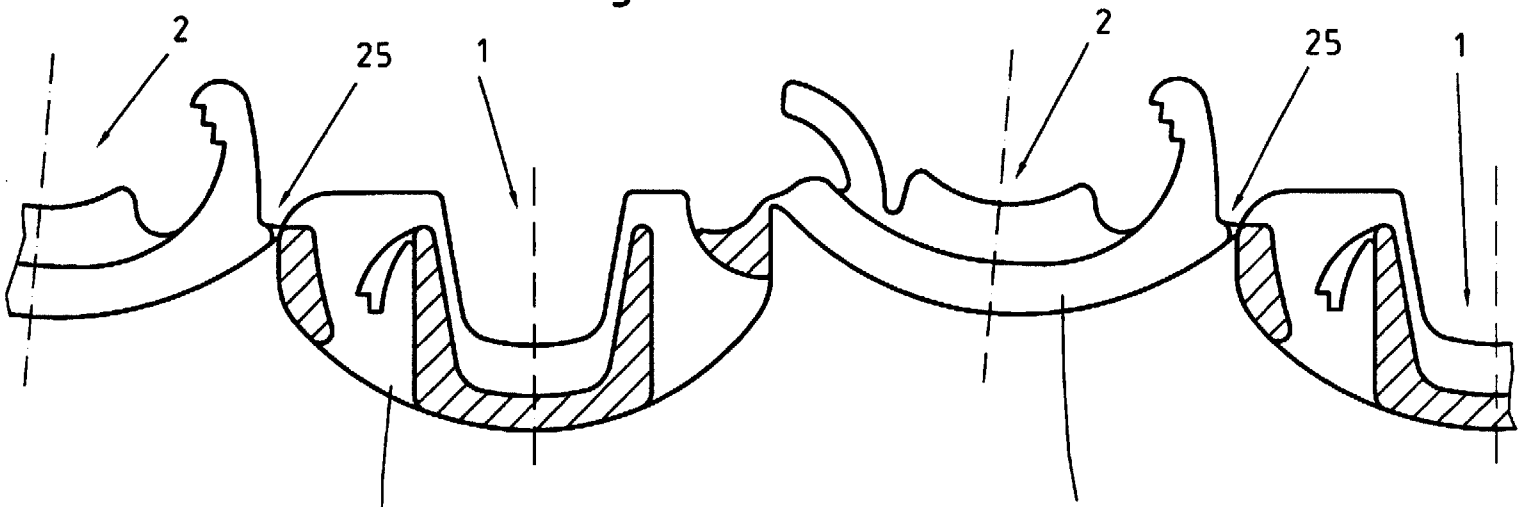
Figure 10:
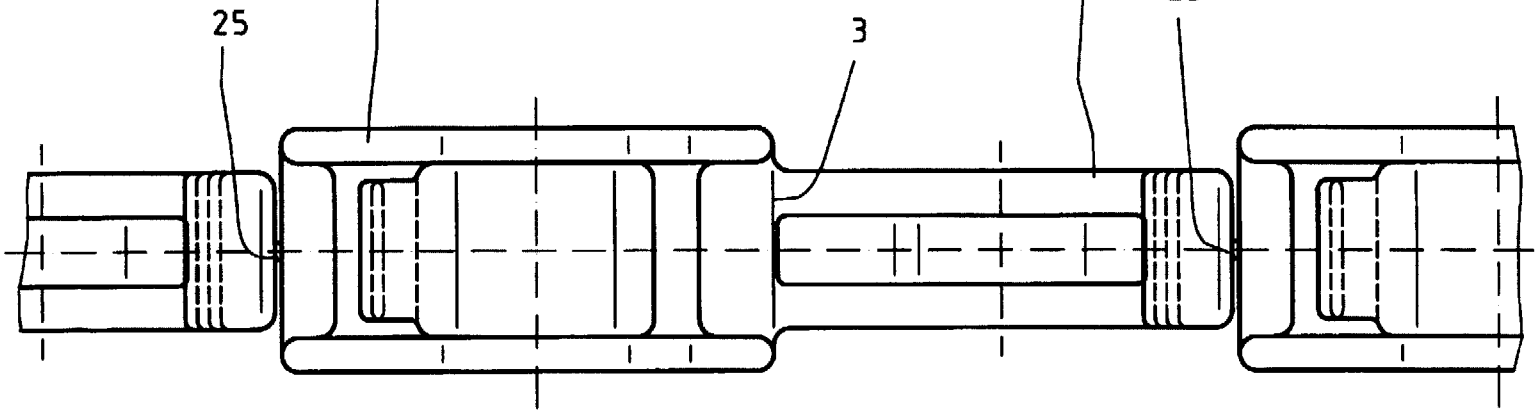
Figure 11:
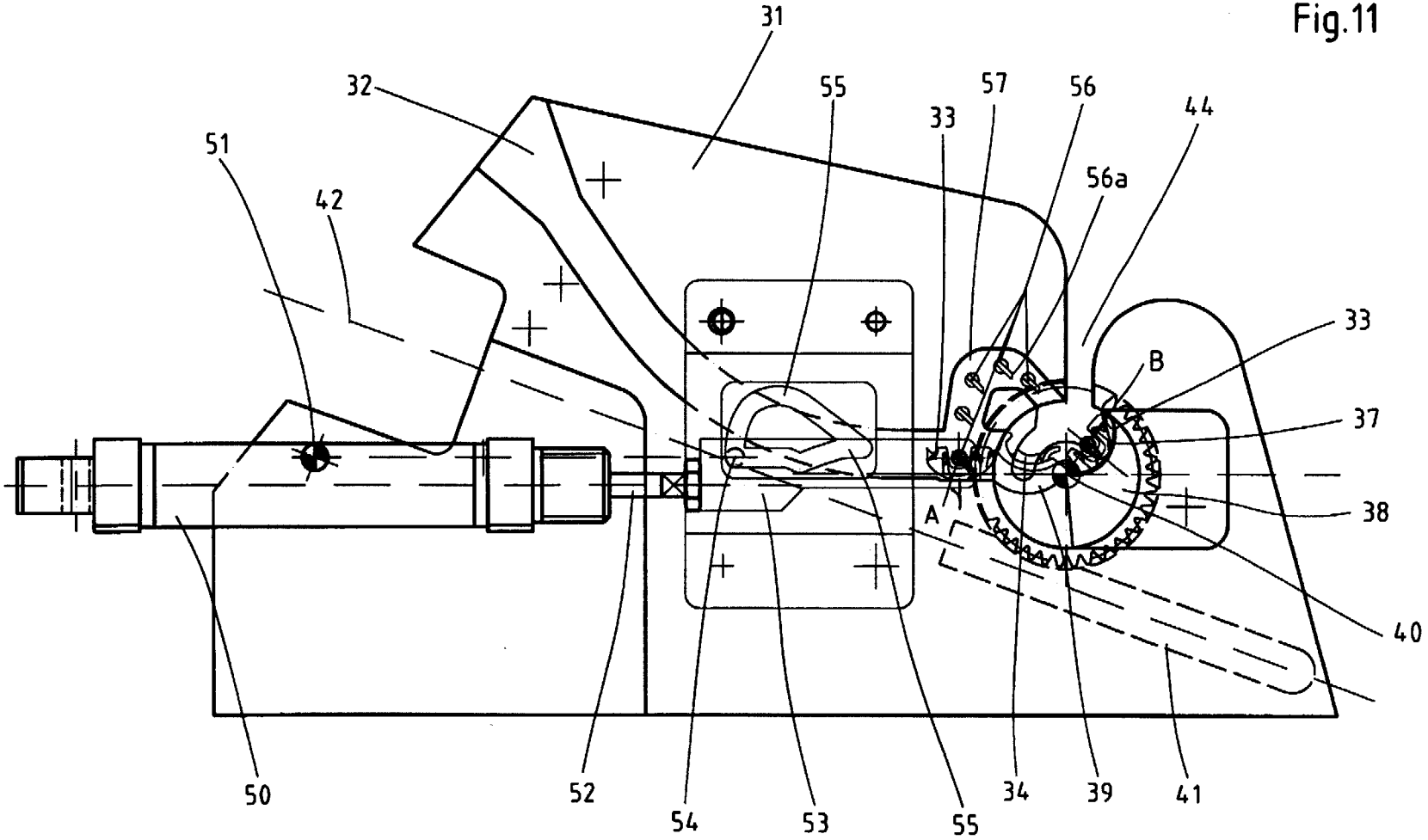
Figure 12:
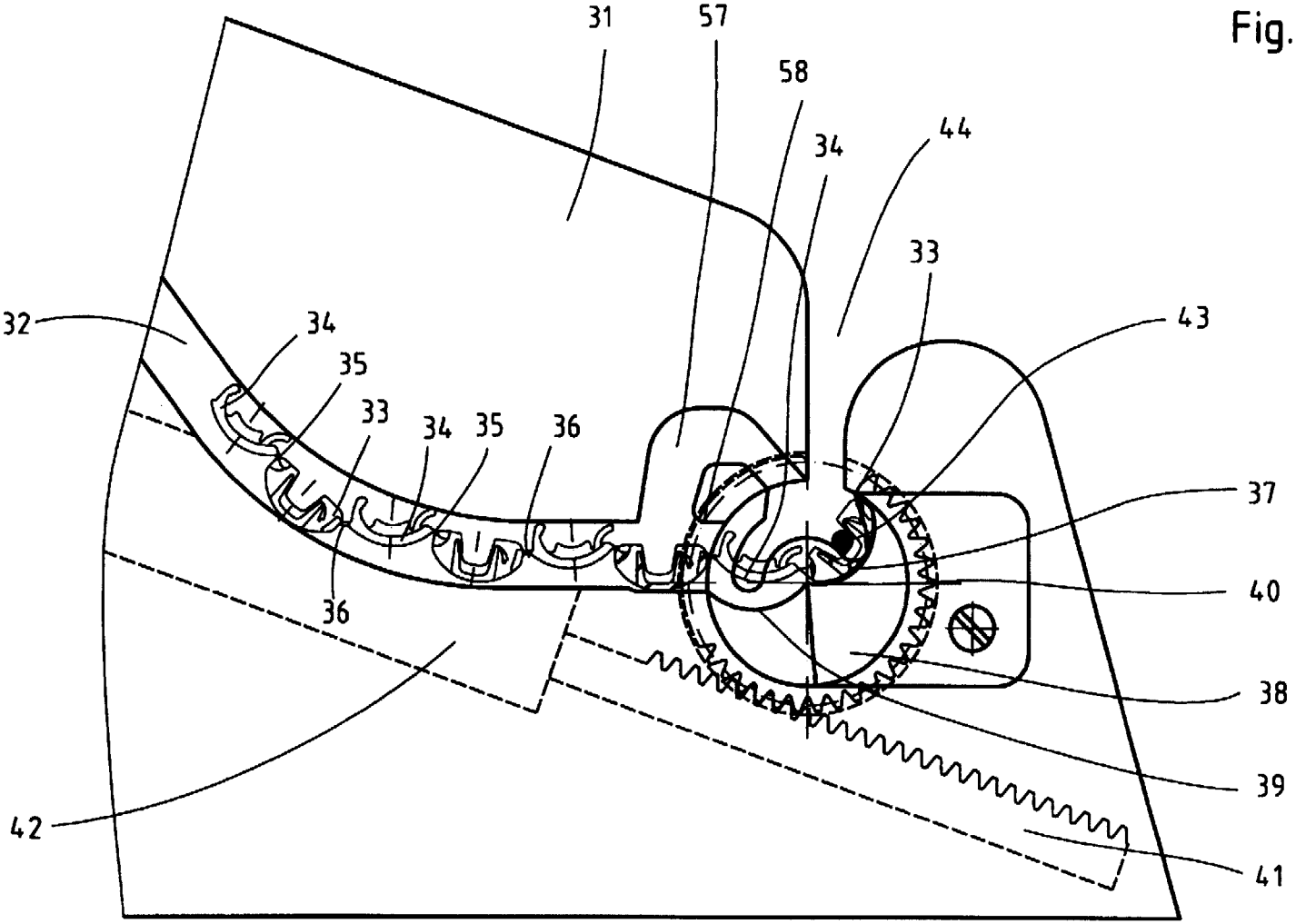
Figure 13:
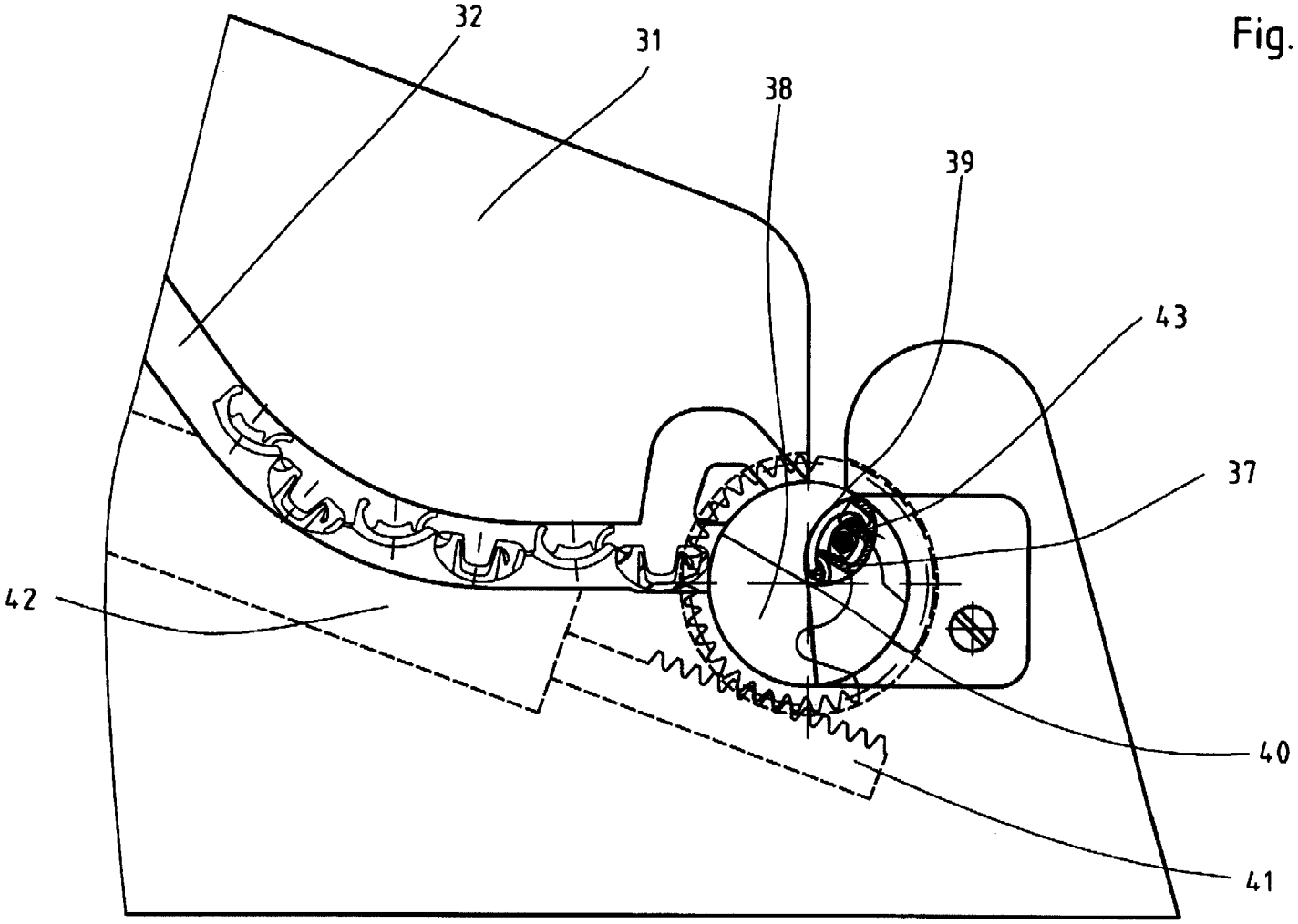
Figure 14A:
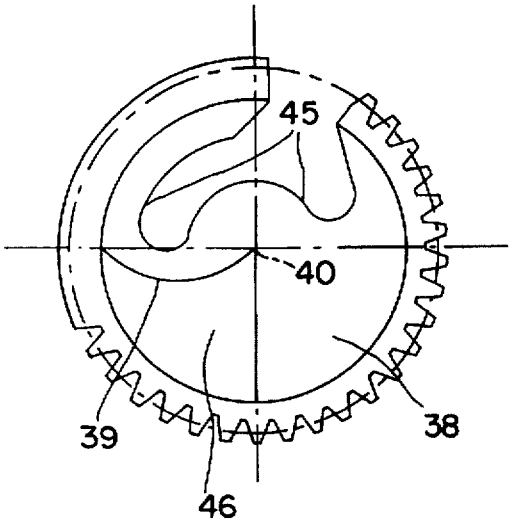
Figure 14B:
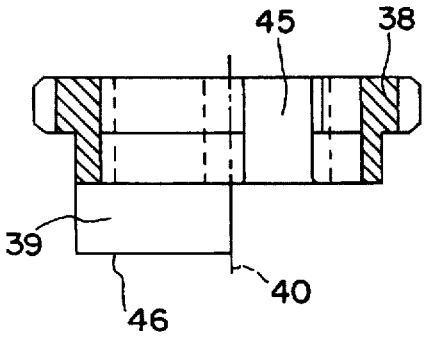
Figure 14C:
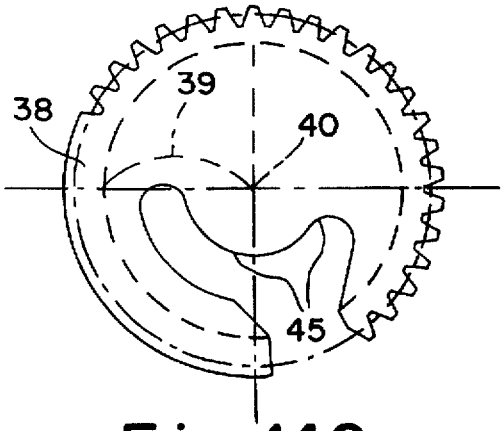
Figure 15A:
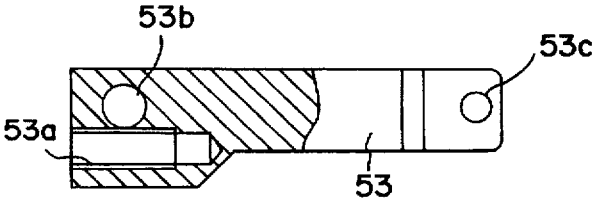
Figure 15C:
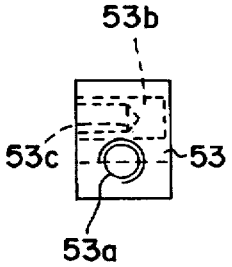
Figure 15B:
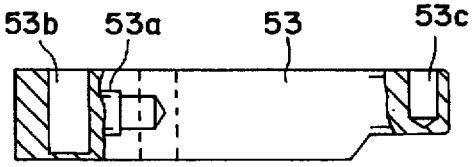
Figure 16B:
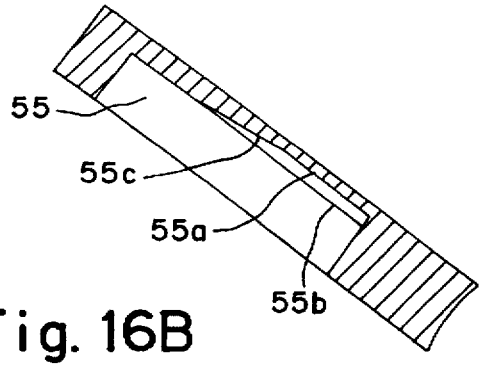
Figure 16A:
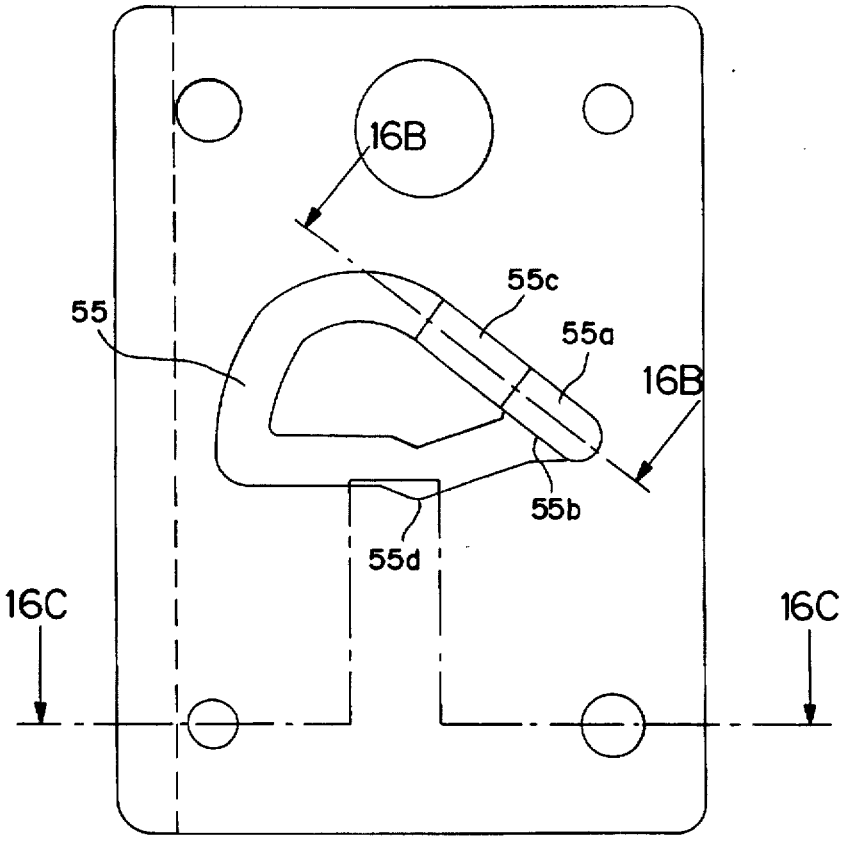
Figure 16C:
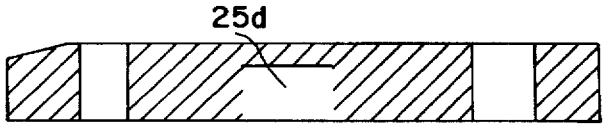

FIG. 1 is a side elevation showing a first embodiment of the invention in an open state, partly in a longitudinal sectional view taken on the I—I in FIG. 2, FIG. 2 is a top plan view showing the clip of FIG. 1, FIG. 3 is a view that is similar to FIG. 1 and shows a second embodiment (section line III—III in FIG. 4), FIG. 4 is a top plan view showing the clip of FIG. 3, FIG. 5 is a view that is similar to FIG. 3 and shows the clip in a closed state (section line V1'V in FIG. 6), FIG. 6 is a central transverse sectional view taken on line VI—VI in FIG. 5, FIGS. 7 and 8 are views which are similar to FIG. 5 and show the closed clip in different detent-locked position, FIG. 9 is a view that is similar to a portion of FIG. 3 and shows a plurality of clips connected in a chain, FIG. 10 is a top plan view which corresponds to FIG. 4 and shows a portion of a chain, FIG. 11 is a diagrammatic general side elevation showing an entire apparatus for closing clips in an initial position but with a clip inserted into the closing mechanism, FIG. 12 is a somewhat enlarged side elevation showing the closing mechanism in the same position as in FIG. 11, FIG. 13 is a view that is similar to FIG. 12 and shows the clip in a closed state, FIG. 14 shows in three different views (a to c) the gear which carries the second holder for the other clip part, FIG. 15 shows in three views (a to c) the slider of the positioning means shown in FIG. 11, and FIG. 16 shows in a top plan view and two fragmentary sectional views the cam slot plate of the positioning means.

In the clip which is shown in FIG. 1 and is made of a sufficiently ahrd but still elastic plastic the first part 1 and the second part 2 are hinged by a film hinge 3. The first part 1 essentially consists of a U-shaped wall, which is constituted by parallel cross-flanges 6 and a bottom 7 and serves as a space 4 for receiving the tip of the sheath. Side cheeks 5 extend from the cross-flanges 6 on both sides and are interconnected close to the film hinge 3 by a cross-bar 8 and at the opposite end by a cross-bar 9. The cross-bars 8, 9 are parallel to the cross-flanges 6.

The second part 2 comprises a bent cover portion 11, which at one end merges into the film hinge 3, which on the other side is integral with the cross-bar 8 of the first part. The width of the cover portion 11 is somewhat smaller than the clearance between the side cheeks 5 of the first part 1 (FIG. 2).

Close to the hinge-side end of the cover portion 11 the second clip part 2 is formed with an arcuate arm 13, which has a concave inside surface 14, which in the closed state of the clip contacts a mating curved surface 15 of the cross-bar 8.

The cover portion 11 is integrally formed at its opposite free end with a detent arm 15, which is provided on the inside with detent projections consisting of detent steps 17, 18, and 19. In the closed clip at least one of the detent steps 17 to 19 engages mating detent steps 20, 21 of a tongue 22, which extends from the top edge of that cross-flange 6 which is adjacent to the cross-bar 9. The tongue 22 extends into the passage 23 between that cross-flange 6 and the cross-bar 9. The (film hinge-like) joint 24 between the tongue 22 and the cross-flange 6 of the receiving space 4 elastically biases the tongue 22 into the passage 23 and causes the tongue 22 to act like a pawl, which during the closing operation can be elastically pivotally moved toward the adjacent cross-flange 6 by the detent arm 15 until those of the detent steps 17 to 19 provided on the detent arm 16 which correspond to the thickness of the tip in a given case engage from behind the detent steps 20, 21 of the tongue 22 whereas the cross-bar 9 engages the detent arm 16 on its other side.

In the second illustrative embodiment shown in FIG. 3 et seq. the first part 1 has a trough-shaped receiving space 4 defined by parallel side cheeks 5 and cross-flanges 6, which are transverse to the side cheeks 5 but are parallel to each other, and also comprises a bottom 7. The side cheeks 5 extend on both sides beyond the cross-flanges 6 and are interconnected close to the film hinge 3 by a cross-bar 8 and at the opposite end by a cross-bar 9. The cross-bars 8, 9 are parallel to the cross-flanges 6. Adjacent to the receiving space 4 the side cheeks 5 are formed with aligned recesses 10, which do not extend as far as to the bottom 7 and into which the sheath tip (not shown) is inserted during the closing operation.

The second part 2 is integrally formed with a rib 42, which extends along the longitudinal center line of the cover portion 11 ever an intermediate part of its length and in the closed clip extends into the receiving space 4 centrally between and parallel to the side cheeks 5. By that rib 12 the sheath tip which has been inserted into the recesses 10 is deflected in the shape of a wave into the receiving space 4 and is fixedly clamped. The arcuate arm 13 is virtually a continuation of the rib 12 in its length.

FIG. 5 illustrates a state in which the detent steps 18, 19 of the detent arm 16 interengage with the detent steps 20, 21 of the tongue 22. FIG. 8 shows a state in which the detent steps 17 and 18 interengage with the detent steps 20, 21. In accordance with FIG. 7 there is an interengagement only between the detent steps 17 and 20 in case of a thick tip.

According to FIGS. 9 and 10 a plurality of similar plastic clips are connected in a chainlike belt, which can, e.g., be wound up in a roll. The clips are connected by severable webs 25, which can be integrally formed with the clips during their manufacturing process and each of which connects the free transverse edge of a second part 2 (close to the detent arm 16) to the free edge of the first part 1 adjacent to the cross-bar 9.

The housing 31 of the apparatus shown in FIG. 11 is internally provided with a feed passage 32 for feeding plastic clips which are arranged in a row in a chain or belt, as is shown in FIGS. 9 and 10. In the arrangement shown in FIGS. 12 and 13 such a strip (portion) is disposed in the feed passage 32. Each clip consists of one part 33 and another part 34, which are hinged at 35 by a film hinge. Adjacent plastic clips are interconnected by easily severable webs 35.

In the position shown in FIG. 12 the positioning means to be described hereinafter have introduced the leading plastic clip of the belt into the closing mechanism, which comprises a holder that is fixed in the housing and consists of a trough 37 for receiving the one clip part 33 and a second holder, which is provided on a gear 38 (see also FIG. 14) and also consists of a trough 39 serving to receive the other clip part 34. The film hinge 35 interconnecting the two clip parts 33, 34 extend in the axis of rotation 40 of the gear 38.

A rack 41 is longitudinally slidable mounted in the housing 31 and from its position of rest shown in FIG. 12 can be moved to its operating position shown in FIG. 13 by means of a pneumatic cylinder, which is indicated only by the dash-dot line 42 in FIG. 11, in which the rack 41 is also only schematically indicated by a contour line.

In response to an operation of the pneumatic cylinder 42 the rack 41 rotates the gear 18 in the clockwise sense about its axis of rotation 40 and the second receiving trough 39 carries the other clip part 34 along until it interlocks with the other clip part 33, which remains fixed in the associated first receiving trough; that position is shown in FIG. 13.

Previously, when the parts were still in their relative position shown in FIG. 12, the tip 43 of a packaging bag, a sausage casing or the like has been introduced through the slot 44 in the housing 31 into the opening of the clip part 33 when that opening was ready to receive that tip, which is represented in FIGS. 11 to 13 by a solid black circle. As the tip 43 is inserted into the plastic clip the tip 43 and the package portions succeeding the tip in its longitudinal direction should not collide with the gear 38 and should not obstruct the pivotal movement of the gear 38 during the closing operation. For that purpose the gear 38 is formed with a suitably shaped recess 45 (FIGS. 14*a* and *c*). It is apparent from FIG. 14*b* that the gear 38 proper is laterally offset from the feed passage 32 and only with a lateral extension 46 having approximately the shape of a quadrant of a circle protrudes into the feed path for the plastic clip. It will be understood that with the second receiving trough 39 formed in the extension 46 and serving to receive the clip part 34 is aligned in that feeding direction with the trough 37 for receiving the one clip part 33.

The means for positioning the plastic clips in the receiving t roughs 37 and 39 are entirely shown in FIG. 11. They comprise a pneumatic cylinder 50, which is pivoted to the housing 31 by a pivot bearing 51 about an axis which is at right angles to the longitudinal axis of the cylinder. The piston 52 is continued by a pusher 53, the shape of which is specifically apparent form FIG. 15. A laterally protruding cam follower pin 54 is fixed to the pusher 53 close to the piston and with a roller mounted in a ball bearing extends into a cam slot 55, which is shown more in detail in FIG. 16. At that end which is opposite to the cylinder 50 the pusher 53 carries a coupling member 56, which laterally protrudes in the same direction as the cam follower pin and positions the clip in the receiving troughs 37, 39.

The design of the pusher 53 is apparent from FIG. 15. The piston 52 is fixed in the tapped bore 53*a*. The cam follower pin 54 is isnerted into the blind hole 53*b*. The blind bore 53*c* serves to receive the coupling member 56.

When the piston 52 of the pneumatic cylinder 50 is in its retracted initial position shown in FIG. 11, the cam follower pin 54 (of the pusher 53) extends into the cam slot 55 at its bottom left corner (FIGS. 11, 16). As the piston 52 is extended the pusher 53 is moved to the right (in FIGS. 11, 15) and the cam follower pin 54 moves in the substantially horizontal Dart of the cam slot 55 to its bottom right corner. As the piston 52 is subsequently retracted into the cylinder 50 a restraining partial recess 55*a* of the cam slot 35 (which owing to that recess has a step 55*b* toward the horizontal portion of the cam slot 55) in conjunction with a laterally outwardly directed spring bias of the roller (not shown) carried by the cam follower pin 54 prevents a return of the cam follower pin 54 into the substantially horizontal portion of the cam slot 55 but causes the pin 54 to move through the arcuate upper portion of the cam slot 55 and to be guided by a ramplike portion 55*c* back to the initial depth of the cam slot 55 (FIG. 16*b*). The pusher 53 and via the piston 52 also the cylinder 50 are constrained to follow the cam follower pin 54 because the cylinder 50 performs a pivotal movement about its pivot bearing 51. When the piston 52 has entirely been retracted to its initial position (FIG. 11), the cylinder 50 has also reassumed its substantially horizontal position. The return movement along the substantially vertical last portion of the cam slot 55 is promoted by the fact that the heavier weight acts in FIG. 11 on the right of the pivot bearing 51.

The coupling member 55 is constrained to follow the above-described movement of the cam follower pin 54 in the cam slot 55 during a cycle of operations of the piston 52 (and of the pusher 53). The coupling member 55 has a projection 56*a*, which conforms to the one part 33 of the clip and which in the initial position of the coupling member 56 extends into and interlocks with that part 33 of the clip; that position of the coupling member 56 is designated "a" in FIG. 11. As the piston 52 is extended and the cam follower pin 54 performs a corresponding movement in the (substantially) horizontal portion of the cam slot 55, the coupling member 56 performs a corresponding movement to the right in FIG. 11 and carries along the clip part 33 and the other clip part 34 hinged thereto. Because during that movement the one clip part 33 must move past the recessed receiving trough 39, the cam slot 55 is formed with a corresponding recess 55*d* (FIGS. 16*a* and *c*), which causes the cylinder 50 and the pusher 53 to perform a small downward pivotal movement and it is ensured that the interlock between the coupling member 56 and the one clip part 33 will not be eliminated. As the outward movement of the piston 52 is continued the coupling member 56 finally urges the one clip part 33 into the stationary receiving trough 37 that the entire plastic clip then assumes its initial position for the closing operation and the coupling member is in position "b". During the succeeding return stroke of the piston 52 the cam slot 55 constrains the cylinder 50 and the pusher 53 to perform a pivotal movement so that the coupling member 56 moves through the passage 57 formed in the housing 31. For the sake of clarity (only) the coupling member 56 is shown there in various intermediate positions. Finally, the coupling member 56 returns to its initial position shown in FIG. 11 while the closing mechanism performs the closing operation described hereinbefore. Unless the coupling member 56 extending into the next following clip constitutes the abutment required for the severing of the clip which is being closed, that function will be accomplished by the abutment 58 of the cardioid portion that is surrounded by the passage 57.

It is claimed:

1. A plastic clip designed for closing sausage casings, bags or the like and consisting of two parts (1, 2), which embrace the casing and gathered to form a tip and can be interlocked with each other, where a first part (1) comprises side cheeks (5), which extend transversely to the longitudinal direction of the tip and have centrally disposed, aligned U-shaped recesses (10), wherein a receiving space (4) that is defined by side cheeks (5) and cross-flanges (6) directly adjoining to the same in a substantially vertical orientation partly embraces the tip and a second part (2), which substantially covers the receiving space, is integrally formed with a projection that consists of a rib (12), which is parallel to the side cheeks (5) and protrudes into the receiving space (4), so that the tip will be deflected in the shape of a wave when the clip is closed and interlocked bridges the cross-flanges (6) of the first part (1), and where at its transverse end the second part (2), is hinged to the corresponding transverse end of the first part (1) by means of a film hinge (3) extending substantially vertical to the side cheeks, has an extension which in the closed condition extends under a portion of the first part and, adjacent to its other transverse end, has a detent element (16), which cooperates with a complementary detent element (20, 21) of the first part (1), and wherein a cross-bar (8) extending parallel, but at a distance from the cross-flange (6) close to the hinge connects the side cheeks (5) of the first part, and an arm (13) at the second part (2) adjacent to the film hinge (3) at a corresponding distance extends between the cross-flange (6) and the cross-bar (8) and below the cross-bar in the closed condition.

2. A plastic clip according to claim 1, wherein a second cross-bar (9) connects the side cheeks (5) of the first part (1) also on the detent side and the detent arm (16) is moved to extend between the second cross-bar (9) and the other cross-flange (6) (passage 23) disposed adjacent to the second cross-bar (9).

3. A plastic clip according to claim 2, wherein the detent projection (20, 21) provided on the other cross-flange consists of a tongue, which extends from the free edge of the cross-flange (6) and rearwardly outside the receiving space (4) and is resiliently prestressed away from the cross-flange.

4. A plastic clip according to claim 3, wherein the detent arm (16) and the tongue (22) are formed with a plurality of detent steps (17 to 21), which permit an adjustment of passages having different widths for the tip.

5. A plastic clip according to claim 1, wherein the free end of the second part (2) is connected to the free end of the first part (1) of a similar clip by severable webs (25) to form chains, which can be stored in a magazine.

6. An apparatus for closing clips of a chain of clips, comprising a stationary first holder (37) for the one clip part (33), a second holder (39) for the other clip part (34), which is pivoted on the hinge axis (35) of the clip parts (33, 34), and a drive means (38, 41) for pivotally moving the second holder (39) from an open clip position to a closed clip position, characterized by a passage (32) for feeding a sequence of clips, which passage opens into the holders (37, 39) at right angles to the pivotal axis (40), and by an abutment (58) cooperating with the pivoted second holder (39) for severing the clip that is to be closed from a chain of clips.

7. An apparatus according to claim 6, wherein the drive means for moving the second holder (39) comprises a gear (38), which by means of a meshing driving member (41) can be turned through a certain angle from the open to the closed position.

8. An apparatus according to claim 6, wherein a positioning means for advancing each clip to be closed into the holders (37, 39) comprises a coupling member (56), which during each feeding cycle is moved into the one part (33) of the clip presented in the feed passage (32), moves the same into the first holder, and subsequently moves back out of the clip and along an arcuate path (57) to its initial position.

9. An apparatus according to claim 8, wherein a coupling member (56) is mounted on the piston pusher (52, 53) of a pivoted fluid-operable cylinder (50) and a cam-follower pin (54) also fixed to the piston pusher extends into a cam slot (55), which controls the movement of the coupling member.

* * * * *